United States Patent [19]

Wirz

[11] Patent Number: 5,009,161

[45] Date of Patent: Apr. 23, 1991

[54] DEVICE FOR CLEANING SHEET-TRANSFER CYLINDERS IN ROTARY PRINTING PRESSES

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 339,065

[22] Filed: Apr. 17, 1989

[30] Foreign Application Priority Data

Apr. 16, 1988 [DE] Fed. Rep. of Germany ..... 3812678

[51] Int. Cl.[5] ..... B41F 35/00

[52] U.S. Cl. ..... 101/425; 101/423

[58] Field of Search ..... 101/425, 423, 424; 15/256.51, 256.52

[56] References Cited

U.S. PATENT DOCUMENTS

| | | | |
|---|---|---|---|
| 1,689,708 | 10/1928 | Wisewood | 101/420 |
| 3,049,997 | 8/1962 | Grembecki et al. | 101/425 |
| 3,120,805 | 2/1964 | Simon | 101/425 |
| 3,261,288 | 7/1966 | Dickerson | 101/420 |
| 3,749,014 | 7/1973 | Gates | 101/425 |
| 3,763,778 | 10/1973 | Sills et al. | 101/425 |
| 4,015,307 | 4/1977 | Kossak | 101/425 |
| 4,393,778 | 7/1983 | Kaneko | 101/425 |
| 4,704,963 | 11/1987 | Nishimura et al. | 101/425 |
| 4,747,348 | 5/1988 | Jeschke et al. | 101/425 |

FOREIGN PATENT DOCUMENTS

| | | |
|---|---|---|
| 1124974 | 3/1962 | Fed. Rep. of Germany . |
| 2332831 | 1/1975 | Fed. Rep. of Germany . |
| 1280310 | 11/1961 | France . |
| 7143539 | 7/1972 | France . |
| 7529384 | 9/1975 | France . |
| 438196 | 6/1967 | Switzerland . |

*Primary Examiner*—Edgar S. Burr
*Assistant Examiner*—Ren Yan
*Attorney, Agent, or Firm*—Herbert L. Lerner; Laurence A. Greenberg

[57] ABSTRACT

Device for cleaning a textured outer cylindrical surface of a sheet-transfer cylinder in a sheet-fed rotary printing press includes a cleaning device corotatable with the cylinder, the cleaning device being replaceably mounted in the printing press and being bringable into engagement with the outer cylindrical surface of the cylinder at a region of the surface not carrying a sheet.

6 Claims, 2 Drawing Sheets

DEVICE FOR CLEANING SHEET-TRANSFER CYLINDERS IN ROTARY PRINTING PRESSES

The invention relates to a device for cleaning a textured outer cylindrical surface of a sheet-transfer cylinder in a sheet-fed rotary printing press.

Considerable problems are caused by the occurrence of smears on sheet-transfer cylinders between two successive printing units and also impression cylinders of a perfector printing unit of a sheet-fed rotary printing press. This results in particular from the very expensive attempts at a solution which are disclosed in the published literature. Even if a very quick-drying ink is used, there is no possibility of reliably assuring that the printing ink which has been applied in the first-form or single-side printing unit is sufficiently dry by the time it comes into contact with the outer cylindrical surface of the cylinder which transfers the sheet to the next printing unit or, in the case of a perfector printing unit, even on the impression cylinder itself, so that there is a slight build-up of ink on the outer cylindrical surface of the cylinder which reduces the quality of the print. In order to avoid this phenomenon, sheet-transfer cylinders of this type have generally been covered with an aluminum plate, which is grained, anodized, sand-blasted or otherwise surface-roughened, to produce an ink-repellent surface. The cylinders have also been provided heretofore with paper carriers which are covered with an adhesive having glass beads embedded therein. It has nevertheless not been possible to overcome the problem thereby.

In another conventional construction, the sheet-transfer cylinder is fitted with rubber blankets covered on one side thereof with glass beads, however, these rubber blankets must be cleaned several times a day, because there is a build-up of ink, above all on the rubber between the glass beads, which results in smearing of the print.

The special fabric described in European Published Non-Prosecuted application Ser. No. (EP-A) 0 059 944, has found a practical application in that it is disposed on the sheet-transfer cylinder with limited freedom of movement and compensates the movement of the paper relative to the cylinder, that movement of the cylinder resulting amongst other things, from the changing curvature of the sheet. Such a fabric must be replaced when it has become soiled to a given extent, but the replacement thereof is difficult to perform, time-consuming and costly. In the printing of certain qualities of paper, for example smooth cardboard, the desired effect does not occur, so that the hoped-for result is fraught with a given risk, which is further aggravated by damage to the fabric which does not immediately become apparent. Moreover, UV inks, when drying, tend to adhere to this fabric, with the result that its use in connection with UV inks increases the risk considerably.

German Pat. Ser. No. (DE-PS) 12 58 873 describes a cylinder surface formed of chrome-plated aluminum sheet with a surface roughness that lies within given limits. Cylindrical surfaces formed in such a manner can be manufactured only at considerable expense and are tied to precisely fixed cylinder diameters so that the unwound aluminum sheet can be secured on the cylinder body with an exact fit.

Such sheet-transfer cylinders must, however, be cleaned at fairly frequent intervals by hand, using a solvent or cleaning agent, for which purpose the printing press has to be stopped.

On the other hand, raised-textured outer cylindrical surfaces of sheet-transfer cylinders has become known heretofore from German Published Non-Prosecuted application Ser. No. (DE-OS) 24 46 188 and other publications. This measure, too, serves to furnish the sheet-transfer cylinder with an outer cylindrical surface which attracts only a small quantity of ink and in so doing counteracts the problem of smearing.

It is accordingly an object of the invention to provide a device for cleaning one or more printed-sheet transfer cylinders of the foregoing general type which requires little time to be set up and ensures, over a long running period and with a high degree of operational reliability, smear-free sheet transport through the use of relatively simple and dependable components.

With the foregoing and other objects in view, there is provided, in accordance with the invention, a device for cleaning a textured outer cylindrical surface of a sheet-transfer cylinder in a sheet-fed rotary printing press, comprising a cleaning device corotatable with the cylinder, the cleaning device being replaceably mounted in the printing press and being bringable into engagement with the outer cylindrical surface of the cylinder at a region of the surface not carrying a sheet.

In accordance with another feature of the invention, the device comprises a rotatingly driven roller, the roller being mounted so as to be readily exchangeable. The roller is mounted, for example, on side walls of the printing-press housing by means of conventional plug-in connector elements and is connectible to a drive. Such a roller may be used in connection with differently formed outer cylindrical surfaces of the sheet-transfer cylinder and may likewise be suitably constructed so that the cylinder, for example is covered with a glass bead blanket or, in a conventional manner, comprises a textured surface of chrome-nickel or the like.

In accordance with a further feature of the invention, the roller is a brush roller having an ink-accepting and an ink-storing effect. The brush roller may, if appropriate, be provided with spirally disposed rows of bristles. Foam-rubber rollers with a plush cover may also be suitable, it being necessary, perhaps experimentally, to determine which type of roller produces the better effect for a given surface of the cylinder. In place of the roller, a cleaning strip may also be provided, which unwinds during the cleaning process from one roll and winds up again onto another roll.

Because the features according to the invention can be implemented not only in simple sheet-transfer cylinders, but also, if necessary, in cylinders with several sheet-transfer surfaces or impression cylinders, it will be necessary to select the specific construction of the cleaning device to suit the operating conditions in order to achieve an optimum effect.

In order to improve the desired effect, in accordance with other features of the invention, the device includes means for driving the roller at a circumferential speed which is different from that of the cylinder or driving the roller at a speed which is lower than that of the cylinder or driving the roller at a speed that is opposite in direction to that of the cylinder. A result of the foregoing driving means is that a wiping motion occurs on the circumference of the cylinder. The difference in circumferential speed between the roller and the cylinders can be achieved by means of an electrical or mechanical drive, if necessary, via additional control elements. With the same objective, the cleaning roller may also be driven in a direction opposite to that of the cylinder.

In order to accommodate the printing operation which is to be performed, the cleaning roller may be either permanently in engagement and rotating at a circumferential speed that is different from that of the cylinder, or may be only temporarily in engagement, possibly at predetermined intervals, it being possible for the intervals to be defined in a control program for the preferably electrical drive of the roller. Moreover, the control of the drive may also include a possibility of axially moving the roller during rotation in order to enhance the wiping effect during the cleaning of the surface of the cylinder.

In some cases, however, it will be sufficient for the cleaning roller to be brought into engagement only at fairly long intervals with the outer cylindrical surface of the sheet-transfer cylinder, for example only in the evening when printing is interrupted.

The roller is replaced the instant the cleaning effect appears impaired. This may occur at different intervals depending upon the printing operation and, in order to be able to perform the replacement as much as possible without interruption of printing and without loss of time, the aforementioned mounting of the roller by quick-fitting coupling elements is of particular significance.

In accordance with yet another feature of the invention, a cleaning agent is included cooperating with the roller for cleaning the surface. The cleaning effect is enhanced by impregnating or supplying cleaning agents such as a solvent or the like to the roller surface. Use may be made of rollers to which a liquid cleaning agent is supplied by an internal system of channels or via a special application roller or in a like manner as soon as the roller is brought into engagement with the outer cylindrical surface of the cylinder. In such a case, in particular, the roller may be disposed under an extraction hood so that the cleaning agent as well as the loosened dirt particles are continuously extracted.

More specifically, in accordance with yet a further feature of the invention, the roller is disposed below an extraction hood having a suction-air connection.

In accordance with yet an added feature of the invention, the roller has at both ends thereof, respectively, parts of quick-fitting couplings, and complementary parts of the couplings are incorporated in bearings supported in side walls of the printing press.

In accordance with yet an additional feature of the invention, the roller is insertable at both ends thereof into the bearings by means of a plug-in connection which is disconnectible by axial movement of the roller against a biasing spring force.

In accordance with still another feature of the invention, means are included for connecting the drive to the drive of the printing press.

In accordance with a concomitant feature of the invention, the roller has an internal system of channels for supplying cleaning agent to be distributed on the outer cylindrical surface of the cylinder.

Other features which are considered as characteristic for the invention are set forth in the appended claims.

Although the invention is illustrated and described herein as embodied in a device for cleaning sheet-transfer cylinders in rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
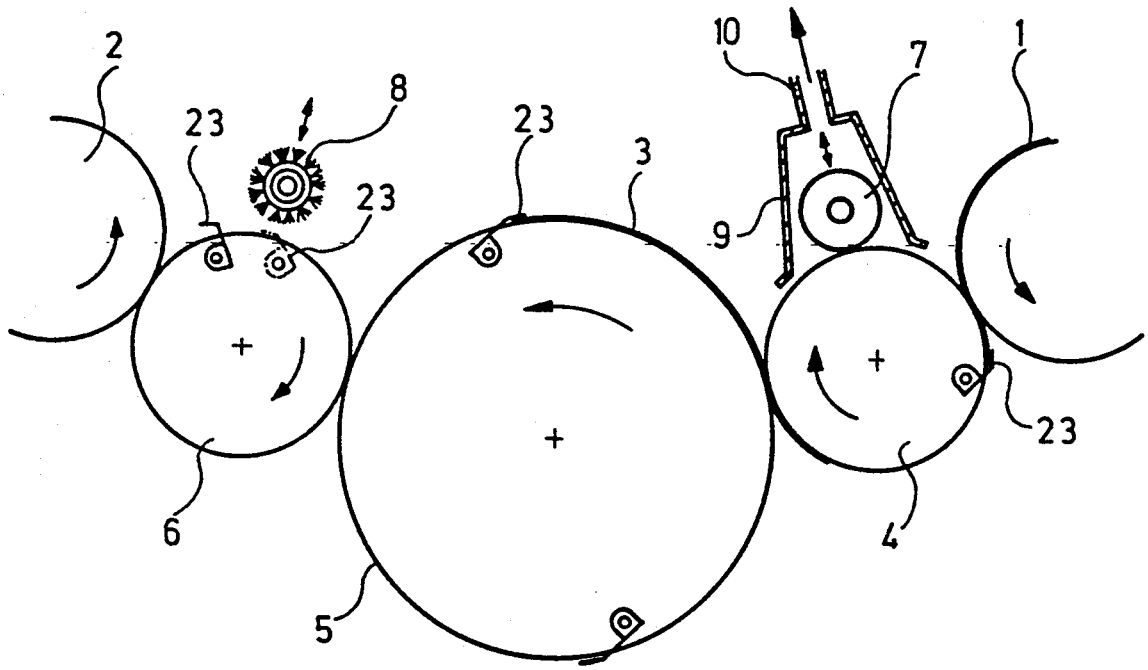
FIG. 1 is a side elevational view of part of a rotary printing press incorporating the device according to the invention.
Figure 2:
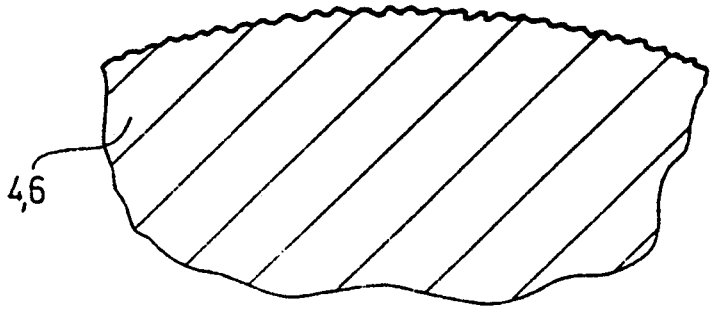
FIG. 2 is an enlarged fragmentary view of FIG. 1, showing a detail of the textured outer cylindrical surface of a sheet-transfer cylinder of the press.
Figure 3:
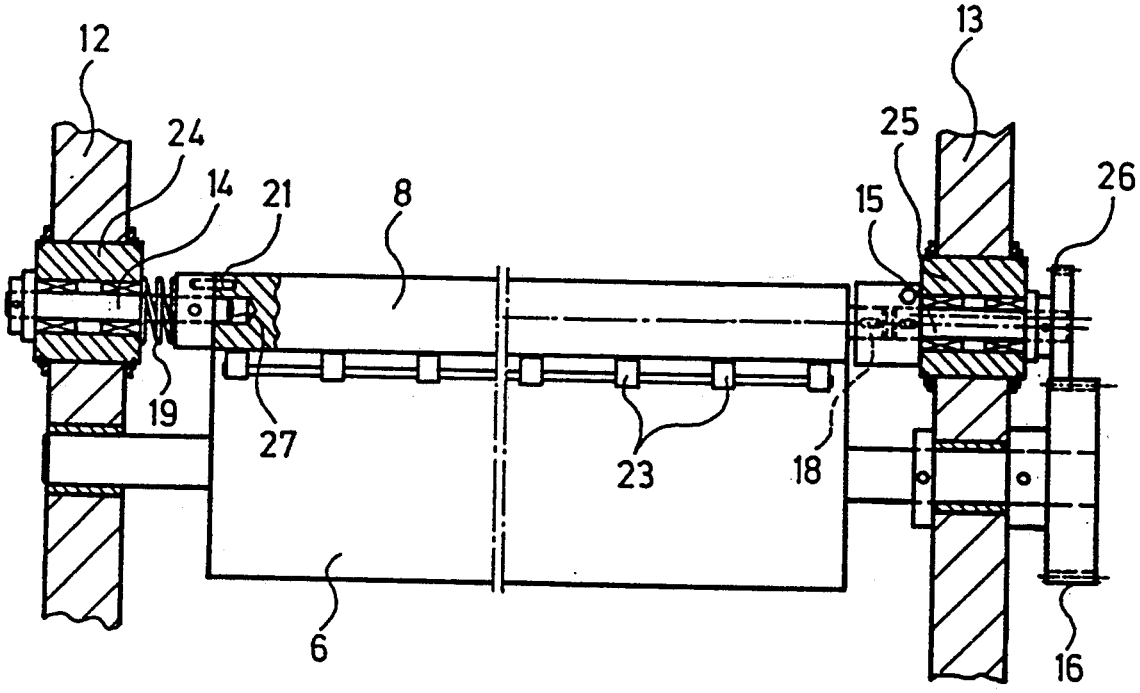
FIG. 3 is a top plan view of an embodiment of a roller of the cleaning device with side walls of the printing press housing shown in cross section.
Figure 4:
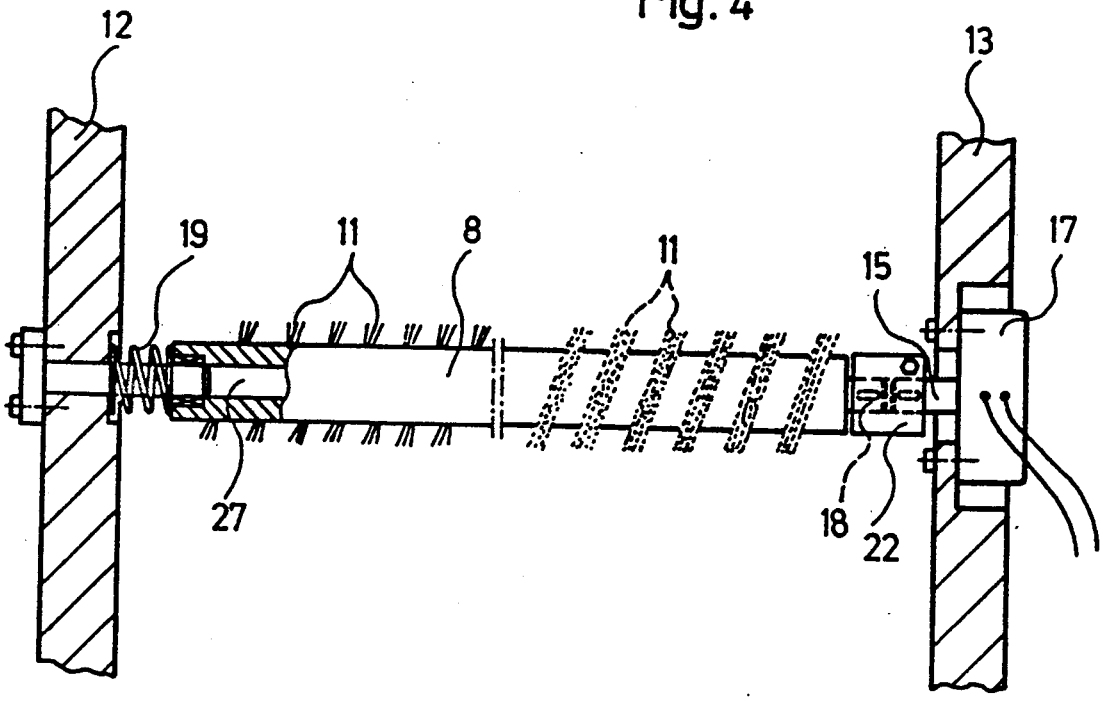
FIG. 4 is a top plan view similar to that of FIG. 3 of another embodiment of the roller.

Referring now to the drawing and, first, particularly to FIG. 1 thereof, there is shown a 3-cylinder sheet-transfer arrangement between two impression cylinders 1 and 2 of two successive printing units. A freshly printed sheet 3 is accepted by a first sheet-transfer cylinder 4 from the impression cylinder 1 of the first printing unit and is passed to a sheet-transfer cylinder 5, the diameter of which is appreciably larger than the first transfer cylinder 4. The sheet-transfer cylinder 6 passes the sheet taken from cylinder 5 to the impression cylinder 2 of the adjacent printing unit. Cleaning devices are provided in this embodiment for cleaning the outer cylindrical surface of the two sheet-transferring cylinders 4 and 6, which are formed with a grained, anodized, sand-blasted or otherwise roughened or textured surface (shown on an enlarged scale in FIG. 2), each of the cleaning devices including a roller 7 or 8, rotatably held in side walls 12 and 13 of the printing-press housing by means of eccentric bearing elements 24 and 25, swivel arms or the like. The illustrated arrangement enables the roller 7 to be brought into engagement with the outer cylindrical surface of the cylinder 4, and for the roller 8 to be brought out of engagement with the cylinder 6, by a rotation of the bearing elements 24 and 25. Illustrated in the right-hand half of FIG. 1 is the arrangement of a roller 7 under an extraction hood 9 with a suction-air connection 10. The construction, arrangement and mounting of the rollers 7 and 8 is illustrated in FIGS. 3 and 4. FIG. 4 shows a brush roller 8, the bristles 11 of which are randomly disposed, advantageously, however, in the form of a spiral, so that the bristles 11 of the cleaning roller 8 touch all the surface areas of the outer cylindrical surface of the cylinder 4 and 6, respectively, when the roller 8 is in engagement. The rollers 7 and 8, respectively, of the cleaning device are held in the side walls 12 and 13 of the housing of the printing press by means of pivot pins 14 and 15.

FIG. 3 shows a mechanical drive with a gear wheel 16 engaging in the gearing unit of the printing press drive and setting the pivot pin 15 into rotation via a transmission gear 26, preferably a toothed belt or the like. FIG. 4, on the other hand, shows an electric drive by a separate electric motor 17. Other forms of drives are possible. Quick-fitting coupling elements, which are constructed in the manner of conventional plug-in type couplings are provided for the quick replacement of the rollers 7 or 8. In the embodiment according to FIG. 3, a plug-in pin 18, provided at one end of the roller 8, engages in an axial bore-hole formed in the pivot pin 15, while an opposite construction exists at the other end of the roller 8 wherein the pivot pin 14 engages in an axial bore-hole 27 formed in a hub of the roller 8, the pivot pin 14 being axially displaceable against the action of a spring 19 in order to release the coupling elements from one another. A ring 20 fixed to the pivot pin 14 has a pin 21 which engages in a bore-hole formed in the end face of the roller 8 and thus establishes a connection between the pivot pin 14 and the roller 8 which fixes them against relative rotation, with the result that the pivot pin 14 rotates in the bearing element 24.

FIG. 4 shows similar coupling elements of a quick-fitting coupling, in which the roller 8 with its axial bore-hole 27 is slideable against the action of the spring 19 on and along the pivot pin 14 in order to withdraw the plug-in pin 18 at the opposite end of the roller 8 out of a sleeve 22 which is connected to the pivot pin 15 so as to be fixed against relative rotation therewith.

Other constructive means for guiding and displacing the rollers 7 and 8 for the purpose of engagement and disengagement are known and for this reason are not illustrated in detail in the drawings. Should soft rubber rollers with a plush cover be used instead of the aforedescribed brush rollers, it is recommended, for the purpose of wear reduction, that the grippers 23 be closed briefly as they pass the rollers 8 and 7, respectively, as is indicated in phantom in FIG. 1 below the roller 8.

I claim:

1. Device for keeping an outer cylindrical surface of a sheet-conveying cylindrical member clean for the purpose of conveying sheets with freshly printed surfaces in a sheet-fed rotary offset printing machine, comprising a roller having an outer cylindrical surface continuously in engagement with the outer cylindrical surface of the sheet-conveying cylindrical member at regions thereof free from engagement by the sheets, the outer cylindrical surface of the sheet-conveying cylindrical member being textured and having means for, respectively, transferring and repelling ink, said surface of said roller continuously in engagement with the outer cylindrical surface having means for removing and storing ink, and including means at least partly carried by said roller for replacing said roller when its means for removing and storing ink ceases to function, said replacing means include, at both ends respectively, of said roller, parts of quick-fitting couplings, and complementary parts of said couplings incorporated in bearings supported in side walls of the printing machine.

2. Device according to claim 1, wherein said roller is disposed below an extraction hood having a suction-air connection.

3. Device according to claim 1, wherein said roller is insertable at both ends thereof into said bearings by means of a plug-in connection which is disconnectible by axial movement of said roller against a biasing spring force.

4. Device according to claim 1, wherein said roller is a brush roller.

5. Device according to claim 4, including a controllable drive for rotating said roller.

6. Device according to claim 5, including means for connecting said drive to the drive of the printing press.

* * * * *